US006361344B1

(12) United States Patent
Yu

(10) Patent No.: US 6,361,344 B1
(45) Date of Patent: Mar. 26, 2002

(54) RETAINER FOR MOUNTING ON A CARD EDGE CONNECTOR

(75) Inventor: Hung-Chi Yu, Hsi-Chih (TW)

(73) Assignee: Hon Hai Precision Ind., Co. Ltd., Taipei Hisen (TW)

( * ) Notice: Subject to any disclaimer, the term of this patent is extended or adjusted under 35 U.S.C. 154(b) by 0 days.

(21) Appl. No.: 09/751,820

(22) Filed: Dec. 29, 2000

(30) Foreign Application Priority Data

Nov. 23, 2000 (TW) ..... 89220361 U

(51) Int. Cl.[7] ..... H01R 13/62
(52) U.S. Cl. ..... 439/328
(58) Field of Search ..... 439/327, 328, 439/470, 596, 731

(56) References Cited

U.S. PATENT DOCUMENTS 4,826,447 A * 5/1989 Forker et al. ..... 439/328
5,190,475 A * 3/1993 Dickens ..... 439/588

* cited by examiner

*Primary Examiner*—Khiem Nguyen
(74) *Attorney, Agent, or Firm*—We Te Chung

(57) ABSTRACT

A retainer (4) for retaining a daughter card (5) in a card edge connector (6) includes a pair of side walls (40) having first and second ends (400, 401), an end wall (41) connecting both side walls at their first ends, a retaining portion (42) formed at the end wall, and an interlocking device (43) including a first arm (431) and a second arm (432) each projecting from a second end of a corresponding side wall and extending toward each other. The first arm forms a first locking portion (441) on an end thereof and the second arm forms a second locking portion (442) on an end thereof. The side walls enclose the card edge connector with the first locking portion catching with the second locking portion and the retaining portion retaining the daughter card within the card edge connector.

11 Claims, 7 Drawing Sheets

RETAINER FOR MOUNTING ON A CARD EDGE CONNECTOR

BACKGROUND OF THE INVENTION

1. Field of the Invention

The present invention relates to a retainer, and particularly to a retainer mounted on a card edge connector for retaining a daughter card in the card edge connector.

2. Description of the Related Art

A card edge connector is commonly used to interconnect a daughter card to a mother board. A retainer may be used with the card edge connector to retain the daughter card in position. The retainer is normally made of a resilient material and is held to the connector by a resilient force between the connector and the retainer. Since manual assembly and disassembly of the retainer to/from the connector is difficult due to the significant resilient force exerted by the retainer, an auxiliary tool must be used.

Referring to FIG. 7, a conventional retainer 2 is assembled to a card edge connector 3 using an assembling tool 1. The conventional retainer 2 extends elongately and comprises a pair of side walls 20 and two end portions 21 connecting opposite ends of the side walls 20. The side walls 20 and the end portions 21 together define a receiving space 22 for enclosing the card edge connector 3 therein. Two pairs of latching portions 23 are formed on each side wall 20 for latching with the card edge connector 3. A handgrip 24 is formed on one end portion 21 and a projection 241 is formed on the handgrip 24 for retaining a daughter card (not shown) within the card edge connector 3. Since the receiving s pace 22 is sized just to enclose the card edge connector 3, the assembling tool 1 must be positioned on an upper face of the card edge connector 3 for guiding the retainer 2 to enclose the card edge connector 3. However, once assembled, it is difficult to disassemble the retainer 2 from the card edge connector 3. Hence, an improved retainer requiring no assembling tool which is also easy to disassemble from the card edge connector is required to overcome the disadvantages of the prior art.

BRIEF SUMMARY OF THE INVENTION

A first object of the present invention is to provide a retainer for facilitating both assembly to and disassembly from a card edge connector.

A second object of the present invention is to provide a retainer requiring no additional assembling tools to aid inassembly and disassembly of the retainer to or from a card edge connector.

A retainer for retaining a daughter card to a card edge connector comprises a pair of elongate side walls, each side wall having a first end and a second end, an end wall connected between the first ends of both side walls, a retaining portion formed at the end wall, and an interlocking device separately formed at the second ends of both side walls. The two side walls, the end wall and the interlocking device together define a receiving space for receiving the card edge connector therein.

The interlocking device comprises a first arm and a second arm separately projecting from the second end of a corresponding side wall and extending toward each other. The first arm forms a first locking portion on a free end thereof and the second arm forms a second locking portion on a free end thereof. When the retainer is assembled to the card edge connector, the side walls enclose the card edge connector and the first locking portion catches with and locks against the second locking portion to firmly retain the retainer to the card edge connector. When the retainer is to be disassembled from the card edge connector, the second arm is moved outward from the first arm so that the locking portions unlock from each other.

Other objects, advantages and novel features of the invention will become more apparent from the following detailed description of the present embodiment when taken in conjunction with the accompanying drawings.

DETAILED DESCRIPTION OF THE INVENTION

Figure 1:
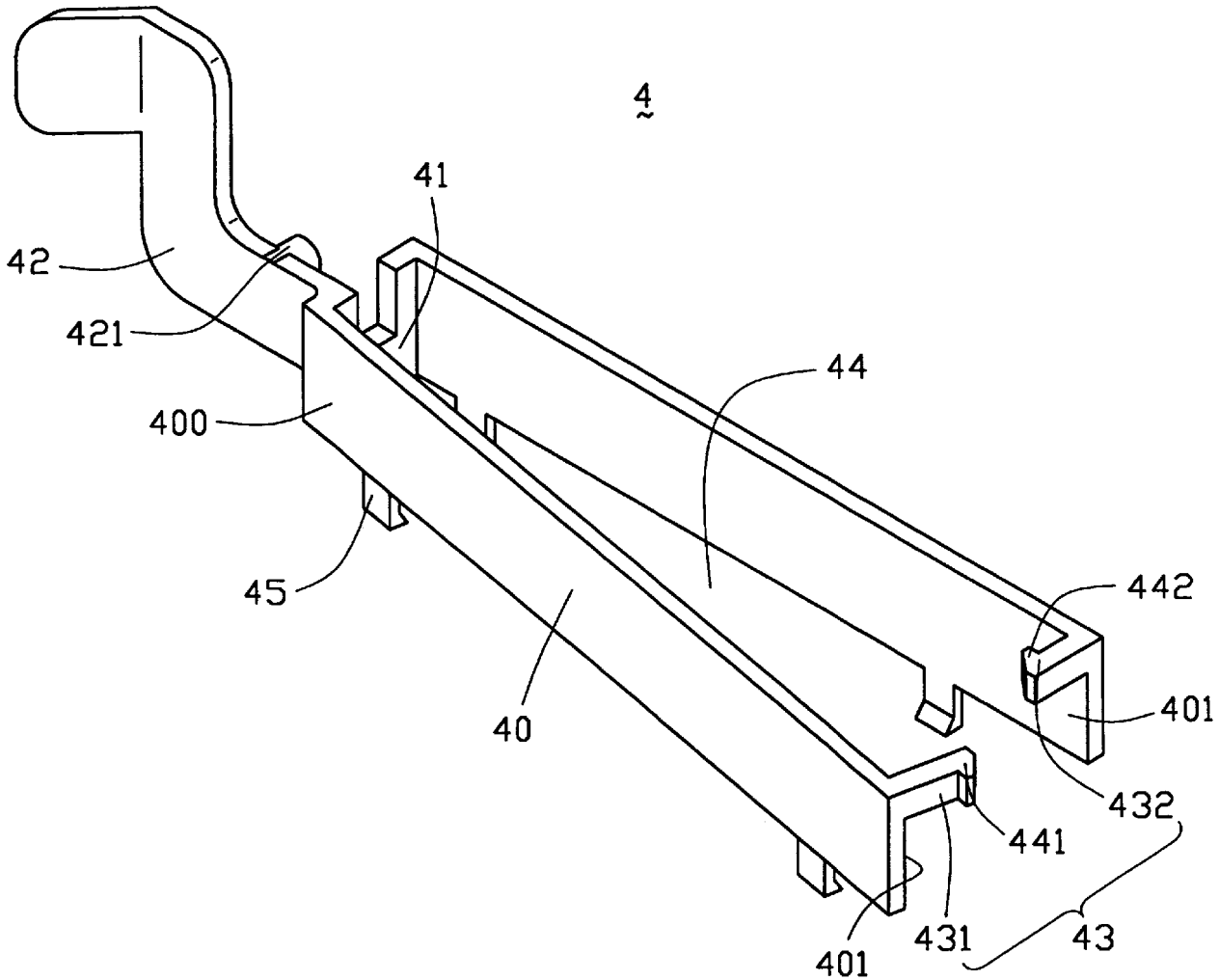
FIG. 1 is a perspective view of a retainer in accordance with a first embodiment of the present invention showing an interlocking device of the retainer in an unlocked condition.
Figure 2:
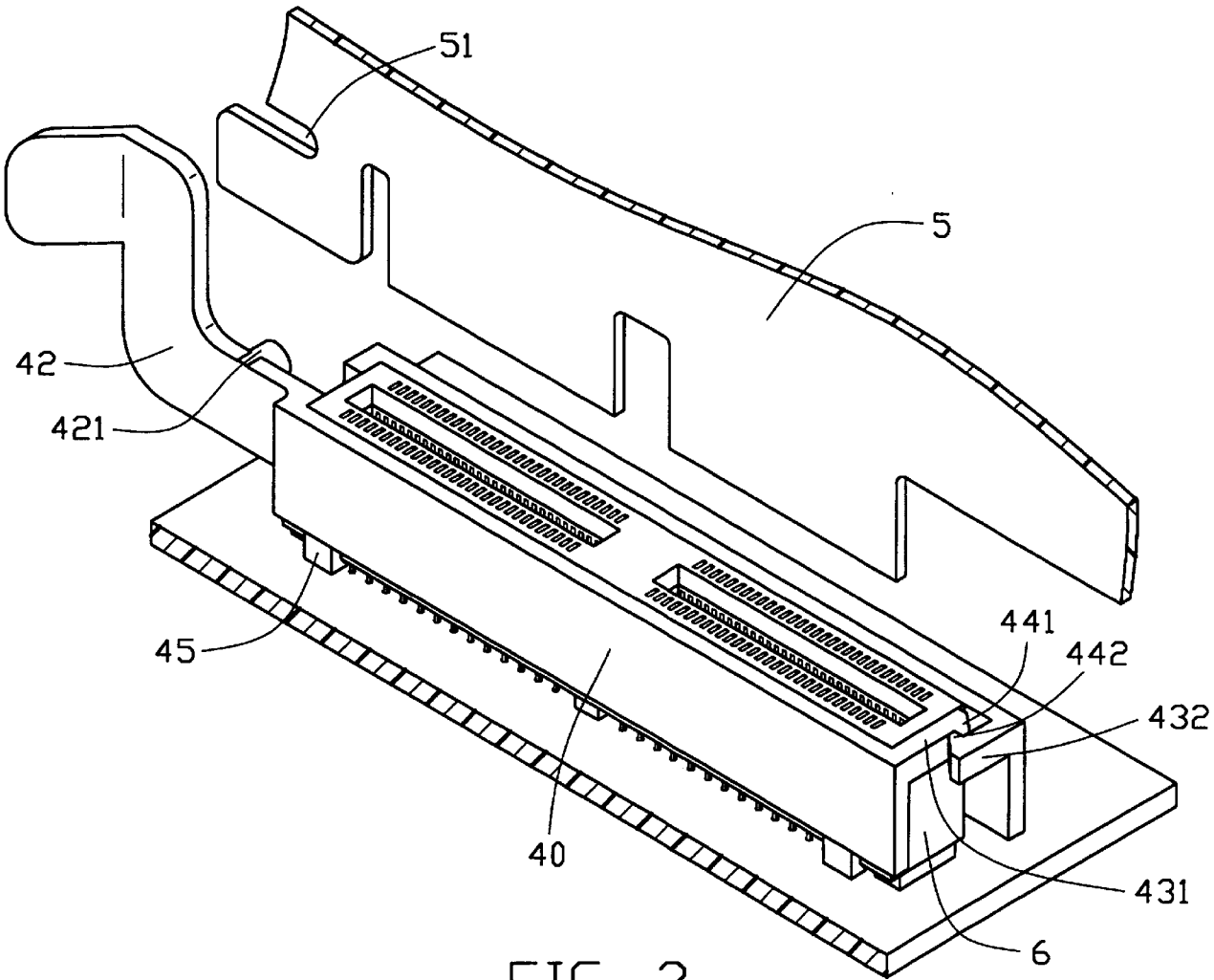
FIG. 2 is a perspective view of the retainer of FIG. 1 assembled to a card edge connector and the interlocking device of the retainer in a locked condition.

Referring to FIG. 1, a retainer 4 for retaining a daughter card 5 (as shown in FIG. 2) to a card edge connector 6 (as shown in FIG. 2) in accordance with a first embodiment of the present invention comprises a pair of elongate side walls 40, each side wall 40 having a first end 400 and a second end 401, an end wall 41 connected between the first ends 400 of both side walls 40, a retaining portion 42 extending from the end wall 41, and an interlocking device 43 formed at the second ends 401 of both side walls 40. The two side walls 40, the end wall 41 and the interlocking device 43 together define a receiving space 44 for receiving the card edge connector 6 therein.

The interlocking device 43 comprises a first arm 431 and a second arm 432 each projecting from an inner face (not labeled) of a corresponding second end 401 and extending toward each other. The first arm 431 formsa first locking portion 441 projecting from a free end (not labeled) thereof and extending parallel to the side wall 40 and away from the end wall 41. The second arm 432 forms a second locking portion 442 projecting from a free end (not labeled) thereof and extending parallel to the side wall 40 toward the end wall 41.

The retaining portion 42 extends resiliently from the end wall 41 opposite the side walls 40, and a projection 421 projects from one face (not labeled) of the retaining portion 42 for engaging with the daughter card 5.

Each side wall 40 of the retainer 4 forms a pair of hooks 45 extending downwardly therefrom for latching to the card edge connector 6 and also seated upon the printed circuit board on which the connected is mounted.

Referring to FIG. 2, when the retainer 4 is assembled to the card edge connector 6, the side walls 40 enclose the card edge connector 6, the first locking portion 441 of the first arm 431 catches with and locks against the second locking portion 442 of the second arm 432, and the hooks 45 catch a lower edges of the card edge connector 6 to firmly engage the retainer 4 with the card edge connector 6.

Figure 3:
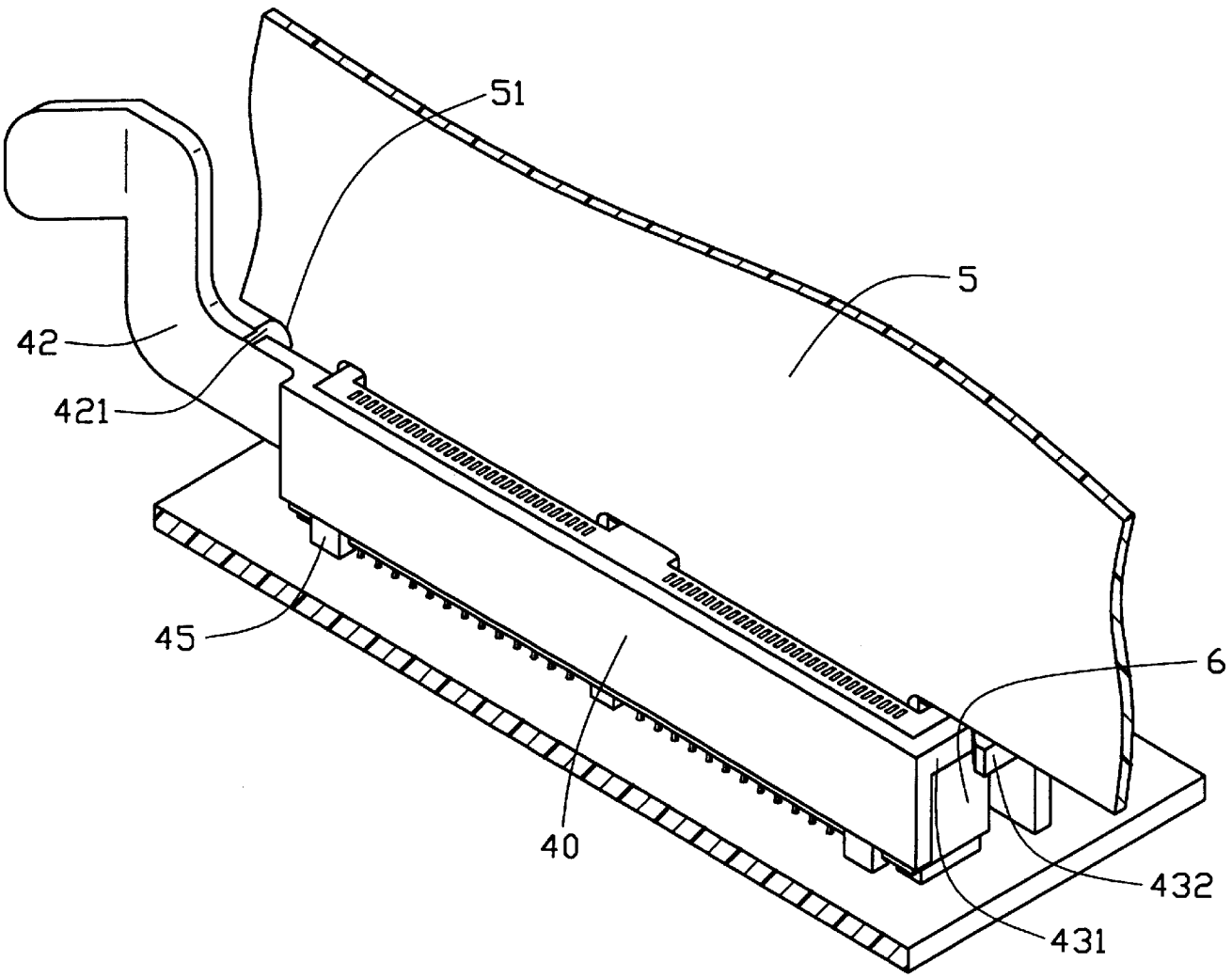
FIG. 3 is a perspective view of a daughter card inserted into the card edge connector and retained within the card edge connector by the retainer of FIG. 1.

Referring to FIGS. 2 and 3, the daughter card 5 is inserted into the card edge connector 6 with the projection 421 received in a notch 51 defined in the daughter card 5 to retain the daughter card 5 within the card edge connector 6.

When the retainer 4 is to be disassembled from the card edge connector 6, the second arm 432 is moved outward from the first arm 431 until the locking portions 441, 442 unlock from each other.

Figure 4:
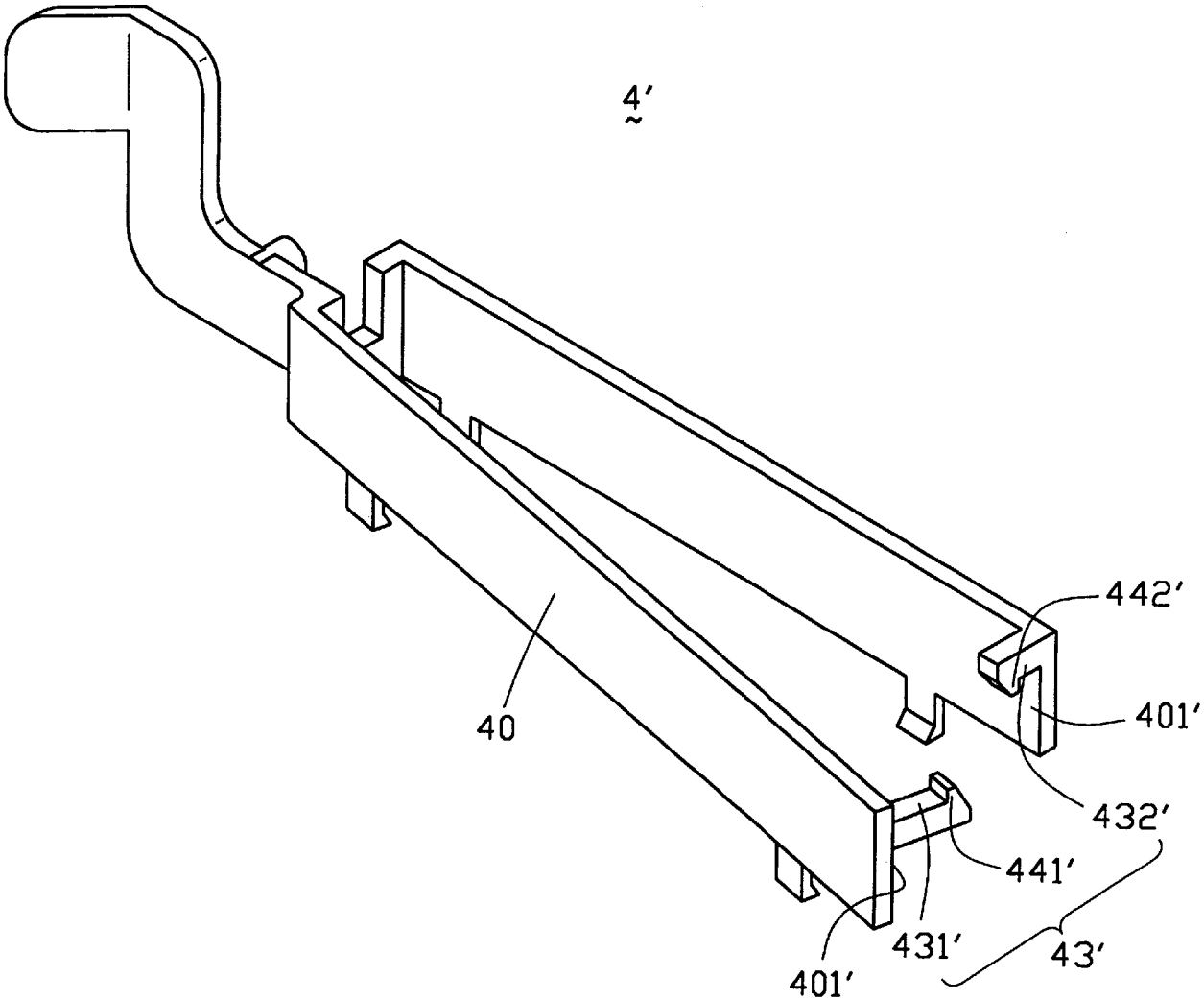
FIG. 4 is a perspective view of a retainer in accordance with a second embodiment of the present invention showing an interlocking device of the retainer in an unlocked condition.
Figure 5:
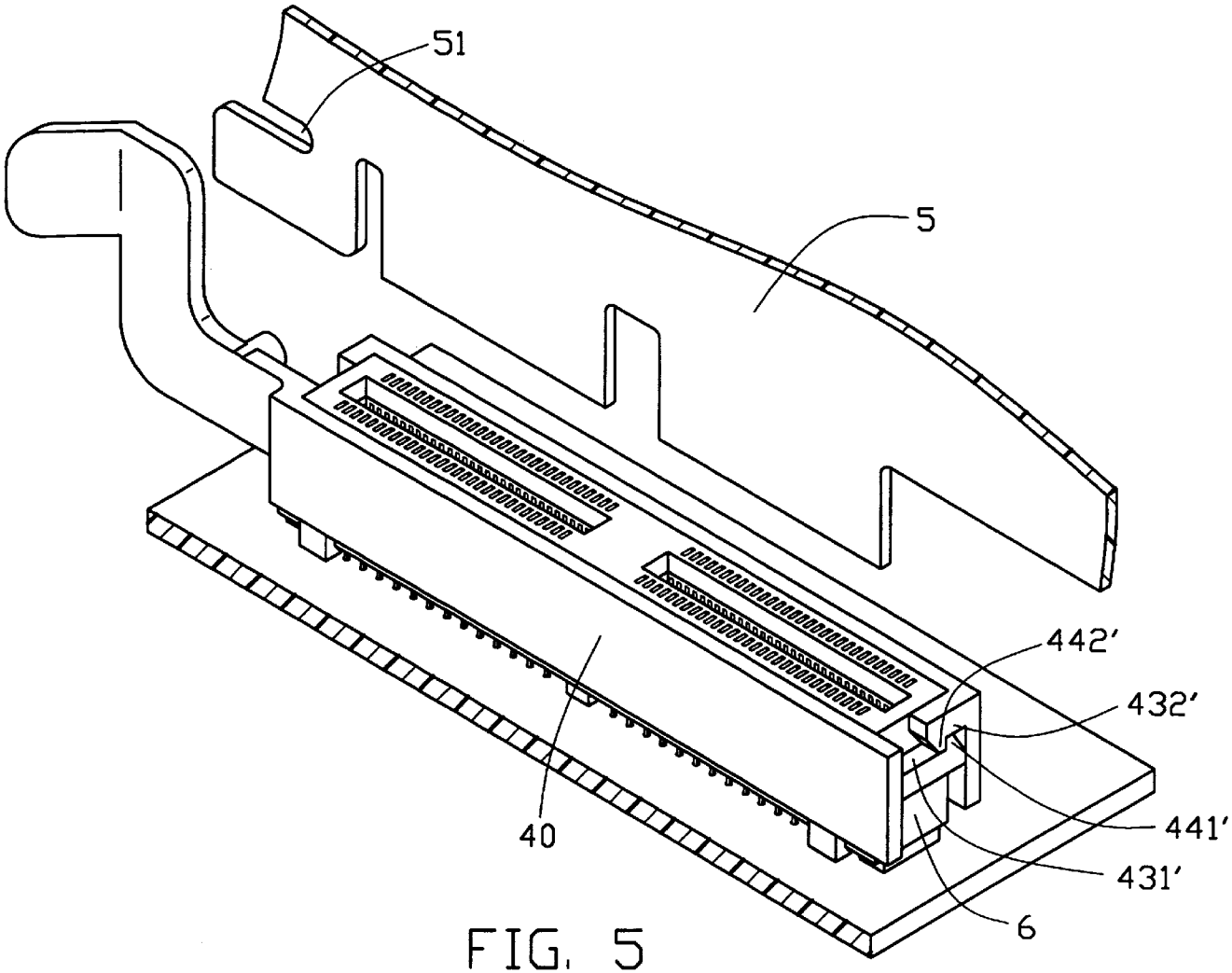
FIG. 5 is a perspective view of the retainer of FIG. 4 assembled to the card edge connector and the interlocking device of the retainer in a locked condition.
Figure 6:
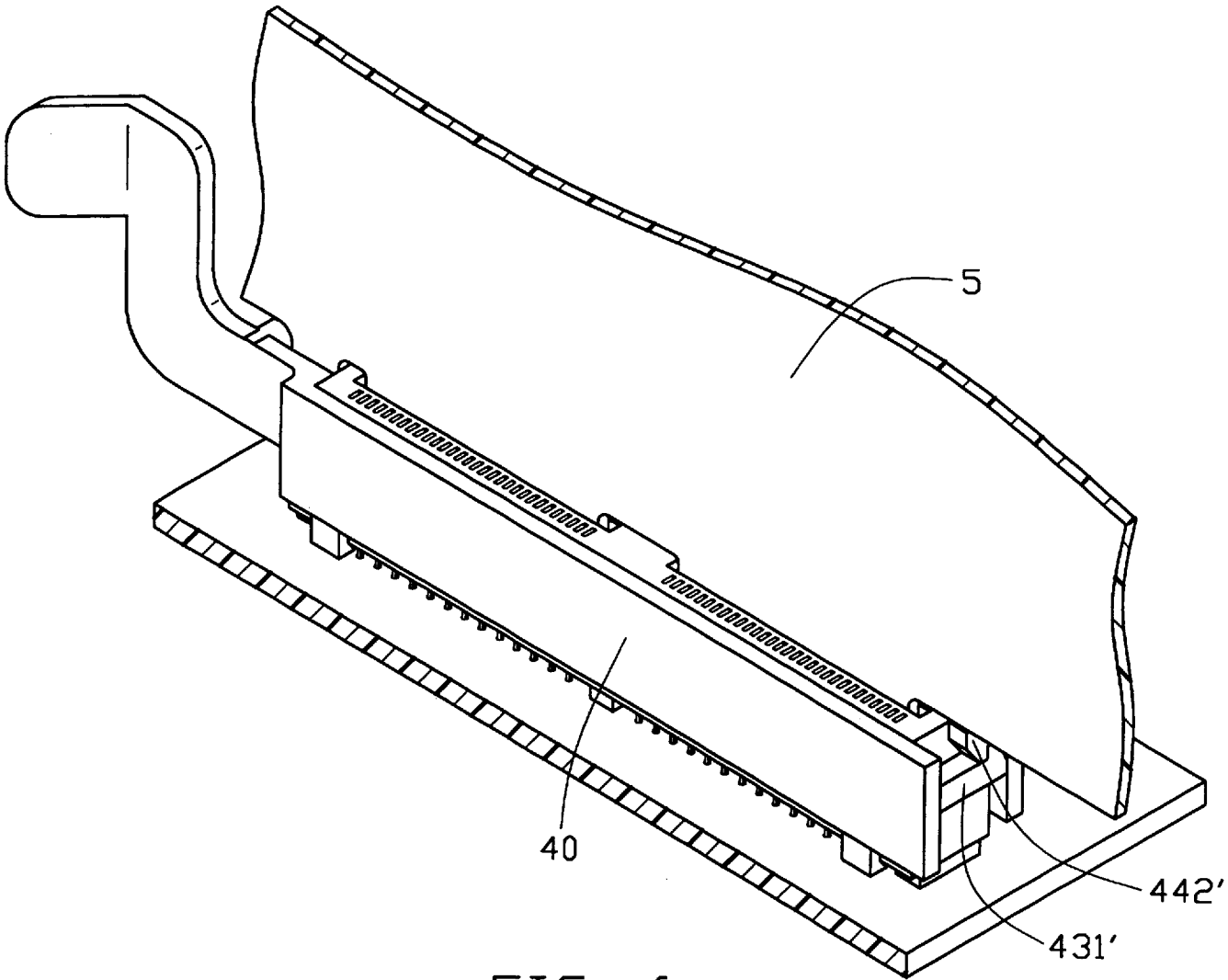
FIG. 6 is a perspective view of a daughter card inserted into the card edge connector and retained within the card edge connector by the retainer of FIG. 4.
Figure 7:
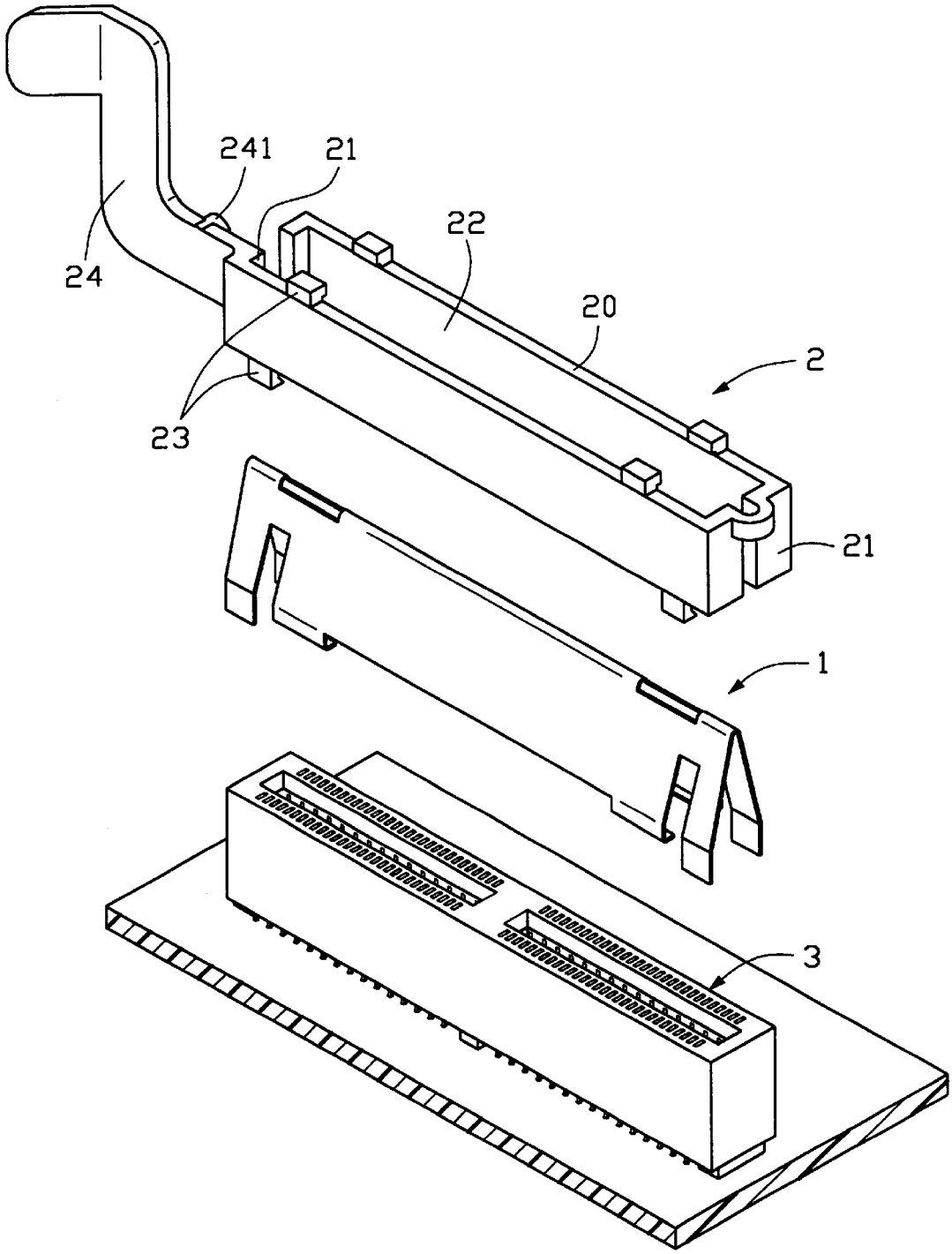
FIG. 7 (PRIOR ART)
FIG. 7 is a perspective view of a conventional retainer for assembly to the card edge connector using an assembly tool.

Referring to FIGS. 4–6, the configuration of a retainer 4' of a second embodiment of the present invention is similar to the retainer 4 of the first embodiment except for an interlocking device 43'. The interlocking device 43' also comprises a first arm 431' and a second arm 432' each projecting from an inner face (not labeled) of a corresponding second end 401' of the side walls 40 and extending toward each other. The first arm 431 ' forms a first locking portion 441' projecting upwardly from a free end (not labeled) thereof. The second arm 432' forms a second locking portion 442' projecting downwardly from a free end (not labeled) thereof. In assembly, the first locking portion 441' can catch with and lock against the second locking portion 442'. When the retainer 4' is to be disassembled from the card edge connector 6, the second arm 432' is pulled upward from the first arm 431' until the locking portions 441', 442' unlock from each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retainer for retaining a daughter card to a card edge connector, the retainer comprising a pair of side walls, an end wall, a retaining portion, and an interlocking device, each side wall having a first end and a second end, the end wall being connected between the first ends of the side walls, the retaining portion being formed on the end wall, and the interlocking device being formed on the second ends of the side walls, the interlocking device comprising a first arm and a second arm separately projecting from the second end of a corresponding side wall and extending toward each other, the first arm forming a first locking portion and the second arm forming a second locking portion;

wherein the two side walls, the end wall and the interlocking device together define a receiving space therebetween, the retainer encloses the card edge connector in the receiving space with the first locking portion catching with and locking against the second locking portion thereby interlocking the first locking portion with the second locking portion, and wherein the retaining portion retains the daughter card within the card edge connector.

2. The retainer as claimed in claim 1, wherein each side wall forms a pair of hooks extending downwardly therefrom and the hooks latch with the card edge connector.

3. The retainer as claimed in claim 1, wherein the first locking portion formed on an end of the first arm extends away from the end wall of the retainer.

4. The retainer as claimed in claim 3, wherein the second locking portion formed on an end of the second arm extends toward the end wall of the retainer.

5. The retainer as claimed in claim 1, wherein the first locking portion extends upwardly from an end of the first arm.

6. The retainer as claimed in claim 5, wherein the second locking portion extends downwardly from an end of the second arm.

7. A connector assembly comprising:

a connector defining a housing with a central slot therein;

a retainer including a pair of side walls connected by an end wall at first ends of said side walls, and a releasable interlocking device formed at second ends of said side walls opposite to said first ends; wherein said side walls, said end wall and said interlocking device commonly define a small space in which the housing is snugly circumferentially received without horizontal movement, while said pair of side walls are adapted to be separate from each other by releasing said interlocking device and pivotally moved about the end wall to leave a large space for disengagement from the housing.

8. The assembly as claimed in claim 7, wherein said retainer further includes a projection for receipt within a notch of a card which is adapted to be received within the central slot, and said projection is close to the end wall and far away from the interlocking device.

9. A retainer for use with a daughter card in a card edge connector, comprising:

a pair of parallel side walls extending along a lengthwise direction;

an releasable interlocking device formed at first ends of said pair of side wall;

a retaining portion extending in said lengthwise direction away from said pair of side walls with a projection thereon; and a plurality of hooks formed on bottom edges of said pair of side walls; wherein said pair of side walls are adapted to be separated from each other once the interlocking device is released, and wherein said retaining portion extends around second ends of the pair of side walls opposite to said first ends.

10. The retainer as claimed in claim 9, wherein an end wall is connected between said pair of side walls at said second ends where the retaining portion extends from.

11. The retainer as claimed in claim 10, wherein said pair of side walls are adapted to pivotally move away from each other about said end wall.

* * * * *